US006533656B2

(12) United States Patent
Hertel

(10) Patent No.: US 6,533,656 B2
(45) Date of Patent: Mar. 18, 2003

(54) AIR HANDLING SYSTEM DUCT CLOSURE AND HEAT TRAP

(76) Inventor: Peter H. Hertel, 1153 Cilley Rd., Manchester, NH (US) 03103

( * ) Notice: Subject to any disclaimer, the term of this patent is extended or adjusted under 35 U.S.C. 154(b) by 0 days.

(21) Appl. No.: 09/886,634

(22) Filed: Jun. 21, 2001

(65) Prior Publication Data

US 2001/0046838 A1 Nov. 29, 2001

Related U.S. Application Data

(63) Continuation-in-part of application No. 09/575,472, filed on May 24, 2000.

(51) Int. Cl.[7] ..... F24F 7/00
(52) U.S. Cl. ..... 454/259; 454/292; 454/360
(58) Field of Search ..... 454/270, 275, 454/284, 292, 259, 360

(56) References Cited

U.S. PATENT DOCUMENTS

| | | | | | |
|---|---|---|---|---|---|
| 101,972 | A | | 4/1870 | Barr | 454/360 |
| 1,943,342 | A | * | 1/1934 | Mortimer | 126/293 |
| 2,192,009 | A | | 2/1940 | Jordan | 98/119 |
| 2,218,348 | A | * | 10/1940 | Boyer | 454/352 |
| 2,599,075 | A | | 6/1952 | Stroup | 98/119 |
| 2,737,879 | A | * | 3/1956 | Cook et al. | 137/527 |
| 3,821,923 | A | | 7/1974 | Dauge | 98/86 |
| 4,215,716 | A | | 8/1980 | Klenk et al. | 137/527.4 |
| 4,334,389 | A | | 6/1982 | Visser | 49/387 |
| 4,727,796 | A | | 3/1988 | Derkach | 98/59 |
| 5,195,927 | A | * | 3/1993 | Raisanen | 137/527.8 |
| 5,201,685 | A | | 4/1993 | Raisanen | 454/275 |
| 5,323,804 | A | * | 6/1994 | Lin | 137/362 |
| 5,569,078 | A | | 10/1996 | Kirkpatrick | 454/292 |
| 5,735,739 | A | | 4/1998 | Daigle et al. | 454/359 |
| 5,766,418 | A | * | 6/1998 | Prough | 162/232 |
| 5,921,862 | A | * | 7/1999 | Ucciardi | 137/527.6 |
| 5,924,922 | A | | 7/1999 | Eakin et al. | 454/256 |
| 6,149,516 | A | * | 11/2000 | Mantyla | 454/349 |

FOREIGN PATENT DOCUMENTS

| | | | |
|---|---|---|---|
| DE | 2 056 717 | 5/1972 | F24F/13/08 |
| FR | 1136162 A | 5/1957 | 454/259 |
| NL | 38043669 B | 7/1938 | 454/259 |

* cited by examiner

*Primary Examiner*—Derek Boles
(74) *Attorney, Agent, or Firm*—Davis & Bujold, P.L.L.C.

(57) ABSTRACT

A counterweight biased duct vent closure and door for a conventional overhead or surface mounted forced hot/cool air supply vent opening. The closure door includes a covering sized to fit over and sealably cover the register or vent opening from communication with the conditioned space when the HVAC system is not in use while automatically opening the cover to provide for treated or forced hot/cool air to be allowed into a space. The duct vent closure provided with an extension forming a counterweight spaced from and rotatable along with the door about a hinge in response to an increase and decrease in air pressure from the duct. Upon generation of a positive air pressure through the duct, the force of air pressure overcomes the gravitational bias provided by the counterweight and the covering is automatically pushed open away from the frame of the apparatus thus enabling the forced air to emanate from the vent and into the room.

5 Claims, 8 Drawing Sheets

AIR HANDLING SYSTEM DUCT CLOSURE AND HEAT TRAP

This is a continuation-in-part of application Ser. No. 09/575,472 filed May 24, 2000.

FIELD OF THE INVENTION

The present invention relates to a gravity biased HVAC duct closure apparatus for a ceiling vent in a structure or building and more particularly, to a counter weighted duct closure system which can be substantially flush mounted against a surface to cooperate with a new or existing HVAC duct system and which automatically opens under the influence of a positive air pressure within the duct, and when the air pressure is negligible, the ceiling vent is automatically sealed by the duct closure via the potential gravity bias of the counter weight to facilitate the retention of treated air previously introduced into the structure or room via the HVAC duct vent.

OBJECTS AND SUMMARY OF THE INVENTION

An objective of the present invention is to provide an automatic duct vent closure to regulate against the backflow of treated air originally introduced to a room through the duct vent to ensure that treated air loss in the form of back flow is kept to a minimum through such a duct vent.

Another object of the present invention is to provide a duct vent closure system which can be easily assembled and installed in combination with either new or pre-existing duct work.

Still another object of the present invention is to provide a duct closure system which is mounted substantially flush with the ceiling so that overhead space within a room is not reduced and the duct vent closure system itself does not impede the flow of air out of the duct or impede the circulation or diffusion of treated air within the structure or room.

Another object of the present invention is to provide an air duct vent closure which is easily removable from the duct vent for maintenance purposes for instance in order to clean the duct vent itself or to clean and wipe free of dust the closure mechanism.

A still further object of the invention is to provide a duct vent closure which breaks up the laminar flow of treated air introduced into the room and causes a desired diffusion of the treated air throughout the room.

Another feature of the invention is the provision of a counterweight attached to and providing a counter balance potential to the door such that when zero positive air pressure is induced in the HVAC duct passageways, the duct vent closure is biased into a closed position by the counterweight such that no air can escape from the room and backflow into the duct passageways.

Another feature of the present invention is that the duct vent closure may be easily removed from the hinging frame apparatus to which it is attached and wiped clean of any dust, dirt or grime which has built up thereupon and then easily put back in place to continue further operation.

This invention relates to a counterweight biased duct closure or door for a conventional overhead or surface mounted forced hot/cool diffuser, vent opening, supply duct or register of an HVAC system, hereinafter referred to as a duct vent. The closure includes a flap or door covering sized to fit over and sealably cover the register or vent opening to insulate the duct passageways from communication with the heated space or air conditioned space when air is not being discharged from the duct and into the room. The duct closure is provided with an extension forming a counterweight to counter balance and influence the door or flap. The counterweight is attached to and spaced from the door or flap about an axis. The door and counterweight are rotatable about a hinge on the axis in response to an increase and decrease of air pressure through the HVAC duct work.

The duct vent closure door and hinge are rotatably secured along a hinge axis to at least a portion of a perimeter frame extending around the periphery of the duct vent opening. The counterweight is spaced from the hinge axis specifically in a direction substantially opposite that of the center of mass of the door in order to provide an opposing force which tends to hold the door sealed and secured against the frame when in the closed position, i.e. when no forced air is being generated by the HVAC system and discharged into the room. Upon generation of forced hot/cold air, a positive air pressure is created in the duct passageways, and the positive air pressure against the door overcomes the sealing bias provided by the counterweight and the covering is automatically pushed open away from the frame of the apparatus, thus enabling the forced air to emanate from the vent and into the room.

The counterbalanced door requires no external power and is designed to automatically seal off and insulate the duct vent opening from the room when the forced hot/cool air and the HVAC fan are off thereby eliminating the ability of treated air escaping back through the registers into an air environment such as an attic or between walls where duct work is commonly routed in many homes and buildings. The frame can be mounted with any conventional attachment means to known vent and register designs, for instance, via magnets or hook and loop closures or conventional bolts or threaded fasteners. The door may remain mounted all year round and can operate during the air conditioning season in conjunction with a forced air conditioning system or a whole house fan, as well as with a heating system during the colder months. The door or closure may also be easily removed and cleaned via a means for detachment to enable cleaning of the vent door.

BRIEF DESCRIPTION OF THE DRAWING(S)

Figure 10:
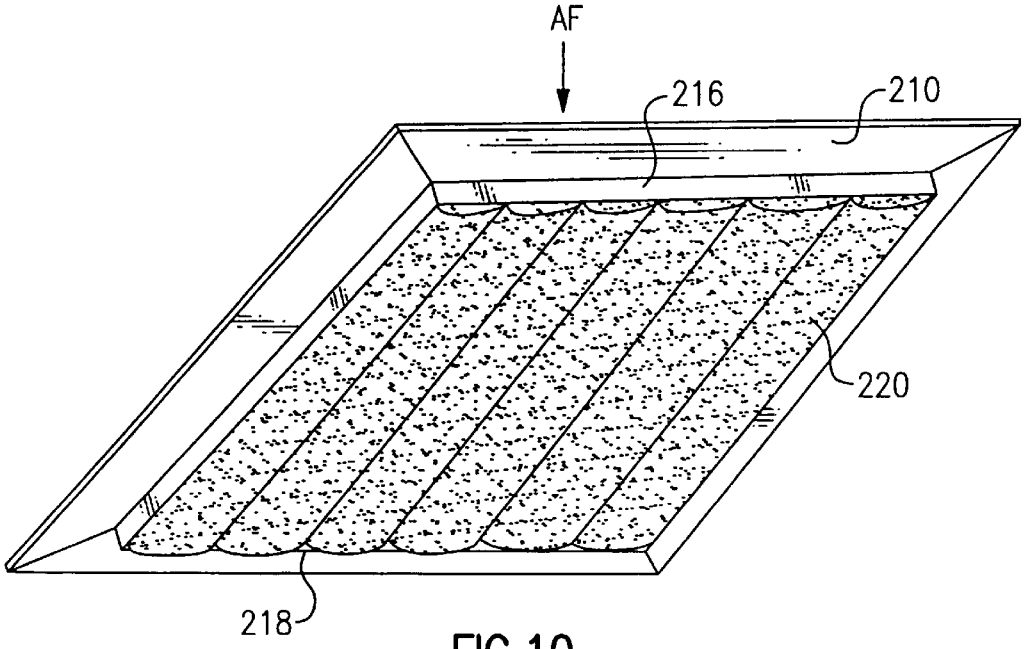
Figure 11:
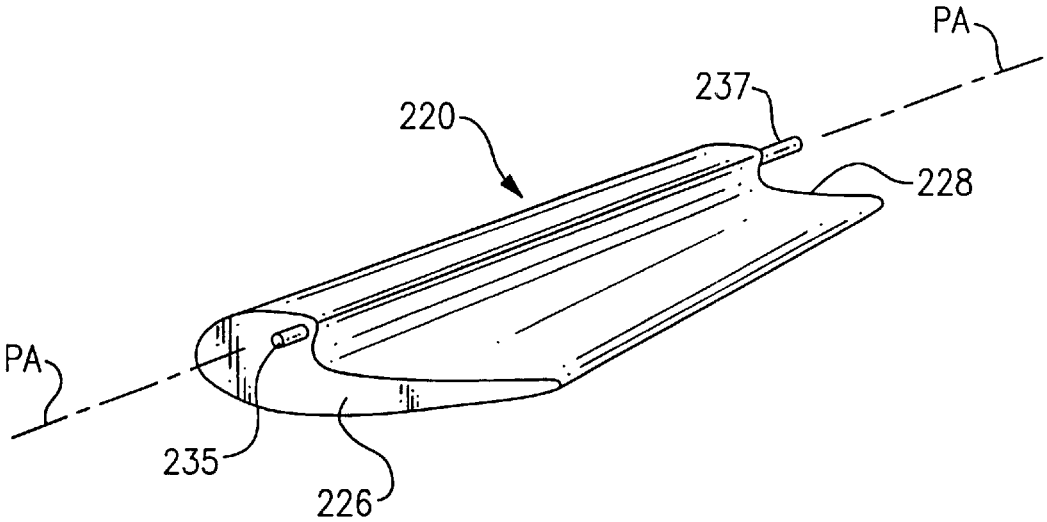
Figure 12:
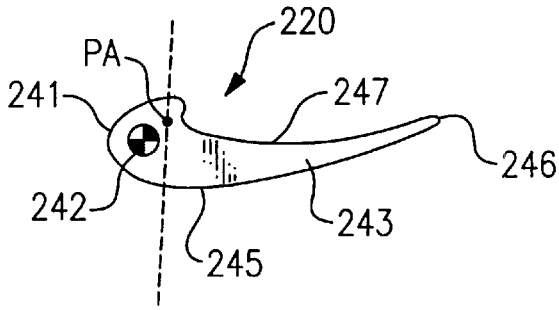

FIGS. 10, 11, and 12 are perspective views of a third embodiment having a plurality of counter weighted louvers.

BACKGROUND OF THE INVENTION

There are various demands for an insulating door or closure mechanism which prevents backflow or reversal of airflow direction through the duct work of an HVAC conduit. Usually, the type of doors and closures available on the market are located on a vertically aligned duct vent opening, for instance on a wall, and pivot about an uppermost portion of a frame adjacent an exhaust fan support system in the exhaust area wherein the air flow pushes the door open and escapes. These doors are often mounted in a substantially vertical manner, specifically on a wall inside a room of a structure.

As is well understood by those of ordinary skill in the art, the vertical positioning of the doors is necessary in order that the weight of gravity acts on the door, closing the door when air is no longer being forced through the conduit. For example, whenever the exhaust fan stops, the airflow ceases and the door, itself under the force of gravity, closes against the exhaust duct of the exhaust fan and provides a seal which prevents air from returning in the reverse direction back into the exhaust area and duct work conduit.

In particular, in large capacity air handling systems, as well as in domestic application HVAC systems, it is increasingly important for energy efficiency reasons that treated air does not flow from the temperature controlled environment back into the duct work and therein be lost. To prevent this occurrence, an airflow reversal prevention door is mounted at the exhaust of a ventilation or an HVAC system, the door is held open by a force of air when there is a positive pressure, and when the air pressure becomes negligible, the airflow ceases and the door reseals by gravitational pull and it remains in a vertical position where it seals and prevents air from reentering the supply ducts of the HVAC system.

While the above described apparatus works particularly well for vertical wall mounted systems, where such a vent closure apparatus is connected to a ceiling in a horizontal manner and parallel with respect to the floor and ceiling, the gravitational effect on the vent cover door would not close the door but would hold the door open such that the treated vented air, in particular heated air, would rise and escape back through the supply vent.

Counterweights have been used in the past to cooperate with such vertical wall mounted devices in opening and closing procedures, however, specifically in a domestic application it is particularly helpful that these counterweights not intrude in a substantial manner into the room such that they take up a significant amount of space therein.

There is no known method which provides for a flush mounted ceiling duct vent closure wherein a counterweight provides for the closing of the door upon cessation of the airflow from the supply duct vent. The present invention solves the problem by providing a unique duct vent closure door which is both counterweight biased into a closed position due to the gravitational influence on the counterweight, and substantially flush mounted with the ceiling.

DETAILED DESCRIPTION OF THE PREFERRED EMBODIMENTS

Figure 1A:
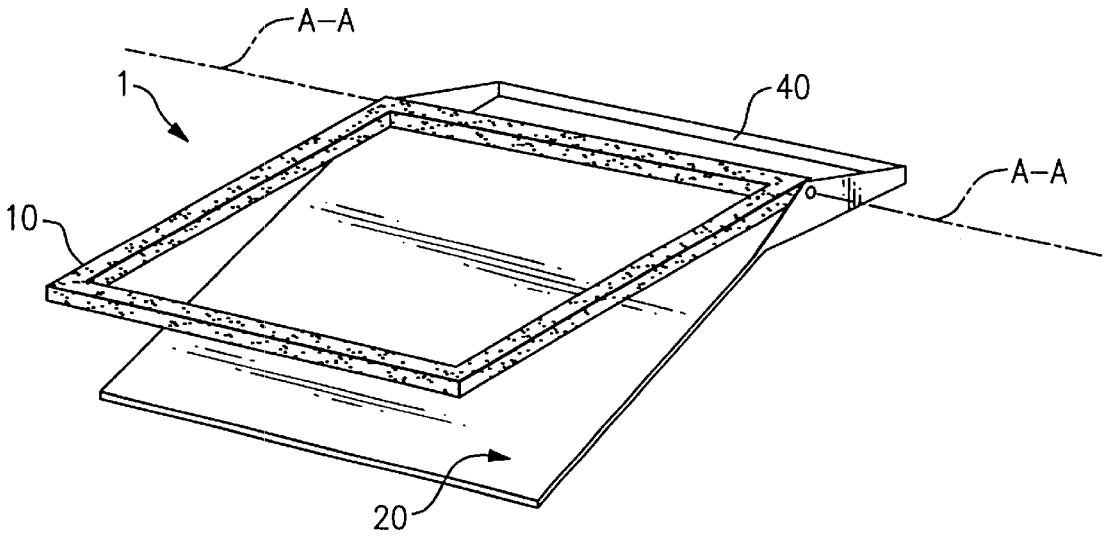
FIG. 1A is a diagrammatic view of the heat duct closure system prior to mounting on a ceiling in conjunction with an HVAC duct vent.
Figure 1B:
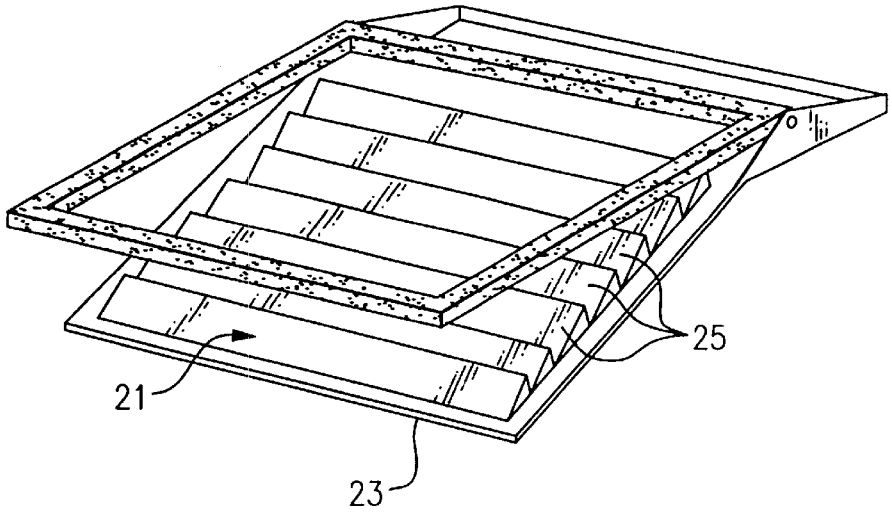
FIG. 1B is a diagrammatic view of the heat duct closure system detailing the laminar air flow disruption surface on an inner surface of the closure door.

Presented in FIGS. 1A and 1B the duct vent closure apparatus of the present invention is indicated in general by the reference number 1. The duct vent closure apparatus 1 incorporates as its main components, a frame 10, having a hinge axis A—A generally incorporated along one side of the frame 10, a door 20 rotatably attached to the frame 10 via the hinge axis A—A, and a counter weight 40 connected to the door 20 for providing gravitational potential to the door 20 rotating about the hinge axis A—A.

Figure 2:
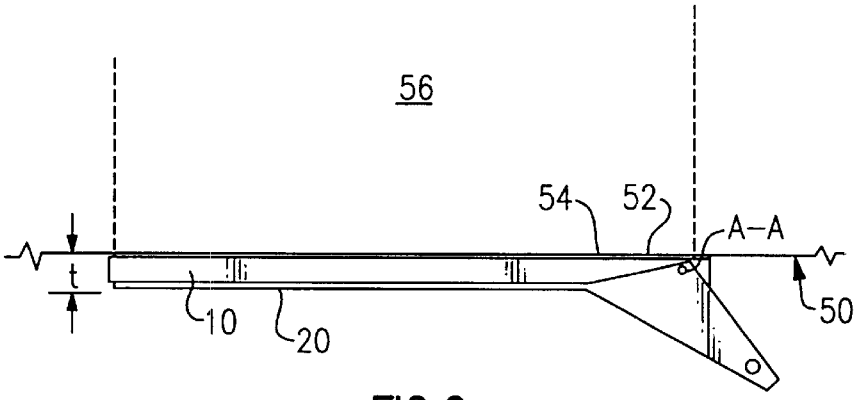
FIG. 2 is a side elevational view of the duct vent closure in a closed position and attached to a ceiling and duct vent.
Figure 3:
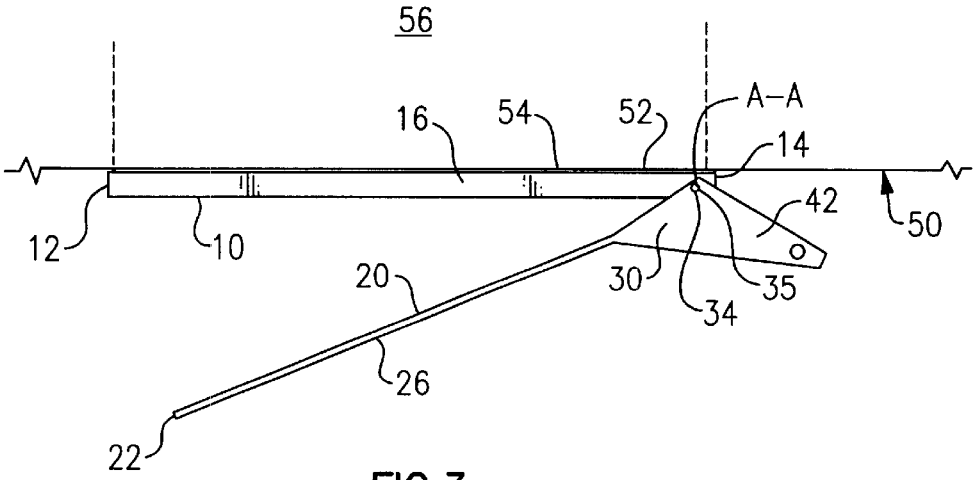
FIG. 3 is a side elevational view of the duct vent closure in an open position where the air is allowed to flow from the duct vent out into the ambient air in the room.

As seen in FIGS. 2 and 3, the duct vent closure apparatus 1 is designed to be mounted to an HVAC duct vent 54 and positioned flush with the ceiling or wall 50 inside a room of a building or structure. The frame 10 may be secured directly to the ceiling 50 or attached in any conventional manner to an existing duct frame or vent of the HVAC duct. The door 20 together with the frame 10 and counterweight 40 does not intrude substantially below the level of the ceiling 50 so as not to significantly encroach upon the overhead space within the room.

The ceiling 50 defines a ceiling opening 52 into which the air flow duct vent 54, of an HVAC duct system 56, is inserted and secured. Treated air, including but not limited to, heated air or cooled air, may be introduced into a room of a building for heating and cooling as well as recirculation purposes through the duct vent 54.

The duct 56 can be of any particular size and supply any desired volumetric flow (cfm) of air at any desired temperature from an appropriate heating and/or cooling system as is well known in the art. As such HVAC air handling systems are well known in the art no further description is provide herein.

The frame 10 of the present invention is in general square or rectangular as shown in FIG. 1, but can be of any particular shape, including circular, to be utilized with any conventional duct vent opening as are generally known in the industry.

The frame 10 can be sized in any manner to encompass the periphery of the two dimensional air flow duct vent opening 54 of the conventional HVAC duct 56.

A particular dimension of importance is the thickness t of the frame 10 and door 20. This thickness t and the attendant intrusion into the room in which the apparatus is located are designed to be as unobtrusive as physically possible.

The thickness t of the frame and door is between about ⅛ inch to 3 inches or more, to ensure its ability to be mounted substantially flush with the ceiling so that the duct work does not substantially extend past the limit of the ceiling 50 and needlessly intrude into a room.

The frame 10 can be mounted substantially co-planer with either the wall or ceiling 50 or the air flow duct vent opening 54 in any conventional manner either with threaded fasteners, adhesive tape, glue, magnetically, or with mechanical fasteners or via other conventional means as are known in the art.

Figure 4:
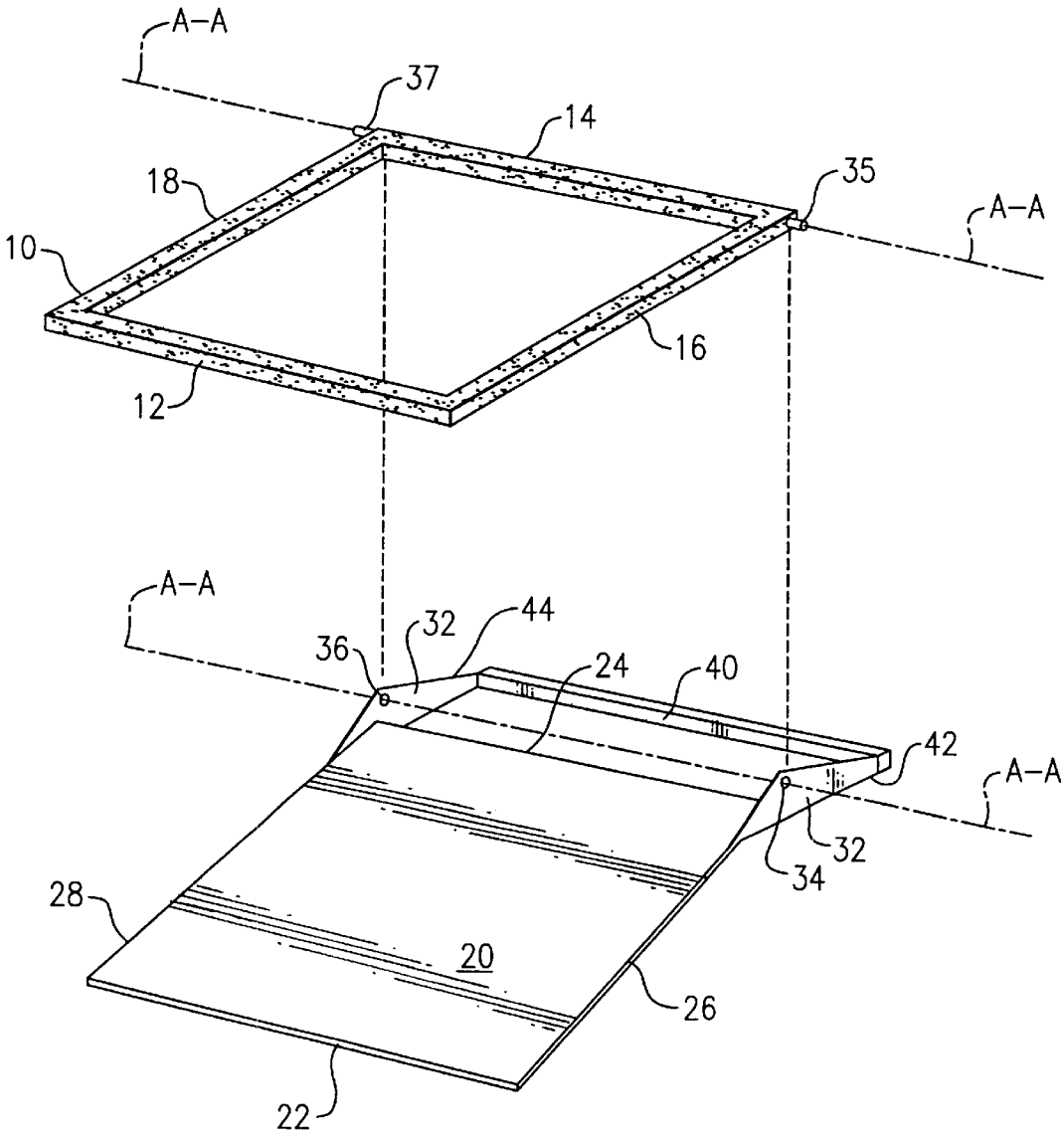
FIG. 4 is a perspective exploded view of the duct closure door separated from the frame.

Turning now to FIG. 4, the frame 10 is formed by a front member 12 separated from a parallel rear hinge member 14 by two opposing parallel side members 16, 18. The frame members 12, 14, 16 and 18 are joined at their respective ends in any manner as is known in the art to form the rigid frame 10.

The frame 10 may also be formed as a one piece unit, e.g. either stamped or molded out of metal, plastic or other material as desired.

The rear hinge member 14 defines the hinge axis A—A extending substantially along the length of the rear hinge member 14. The hinge axis A—A includes opposing ends delineated via a first hinge pin 35 and a second hinge pin 37 extending co-linearly along the hinge axis A—A from opposing ends of the rear hinge member 14. The hinge pins 35, 37 protrude perpendicularly with respect to the side members 16, 18, and extend a short distance beyond an outermost edge of the side frame members 16, 18 and provide a protruding support to engage with and rotatably support the door 20.

The door 20 is a generally planer solid surface corresponding essentially to similar dimensions as the frame 10. The door 20 is defined by a front edge 22 and a parallel rear hinged edge 24 separated by a parallel first side edge 26 and second side edge 28 defining the limits of the planer solid surface. The front edge 22, rear hinged edge 24 and first and second side edges 26, 28 of the door 20 are arranged to sealably engage with the front member 12, the rear hinge member 14 and the first and second opposing parallel side members 16, 18 respectively with the frame 10.

The door 20 is of particular importance with regards to the diffusion of air flow throughout the room. Returning to FIG. 1B, the duct vent door 20 has an inner surface 21 and an outer surface 23, the inner surface 21, faces inwardly into the duct 56 and the outer surface 23 being essentially exposed to the ambient room air faces outwardly into the room. As will be explained in greater detail below, the air pressure induced airflow which exits from the duct work 56 and the air pressure differential caused thereby, influencing the door 20 to open and the treated air to emanate therefrom. As is also well known to those skilled in the art, the treated air emanating into the room should be diffused and thoroughly mixed throughout the existing air in the room to produce an efficient and desired environment. The air flow which emanates from the duct work 56 is generally in an undesirable laminar flow. Without diffusing or breaking up such a laminar flow, the treated air will not efficiently disburse or diffuse throughout the room, but for example, may be directed along a wall or a ceiling where it will remain in a stratified layer and fail to provide consistent diffuse and desired ambient temperature throughout the room.

The air flow emanating from the duct vent 24 will at least partially come into contact with the inner surface 21 of the door 20. The positioning and orientation of the door 20 thus directs, at least in part, the air flow from the duct vent into the room. In order to break up the laminar flow and provide a desired diffuse mixing of the air, the inner surface 21 of the door 20 can be provided with air flow interference objects 25 such as vanes, gratings, ridges, undulations and other similar apparatus as are known in the diffuser art. These air flow interference objects 25 facilitate the break up of the substantially laminar flow across the surface of the door 20 and provide a thorough mixing of the treated air with the air already present in the environment of the room.

Observing FIG. 4, the rear hinged end 24 of the door 20 supports a first and second aperture flange 30, 32 defining an associated first and second attachment apertures 34, 36. When the door 20 is rotatably engaged with the frame 10, the attachment apertures 34, 36 are supported by the first and second hinge pins 35, 37 respectively and are axially aligned along the length of the rear hinged end 14 and co-linear with respect to the hinge axis A—A. The attachment apertures 34, 36 are sized to matably receive one of said opposing hinge pins 35, 37 of said rear frame member 14 in order to facilitate rotatable attachment of the door 20 to the frame 10.

A counter weight 40 is rigidly attached to the door 20 to provide a desired gravitationally biased closing force tending to force the door into a closed position to be described in further detail below. The counter weight 40 is spaced from and parallel to the rear hinged end 24 of the door 20 and is connected between a first and second side extensions 42, 44 which extend rearwardly from the first and second aperture flanges 30, 32. The first and second side extensions continue the aperture flanges past an intersection with the hinge axis A—A to support the counterweight substantially opposite from the door 20.

The counter weight extends parallel to and along the length of the rear hinged end 24 of the door 20. The counter weight 40 is attached at either end to the first and second side extensions 42, 44 respectively of the aperture flanges 34, 36. The counterweight has a constant cross-section and weight along the length of the counterweight 40 extending between the first and second side extensions 42, 44.

Observing FIGS. 2 and 3, the duct closure is provided with an open position, (FIG. 2), and a closed position, (FIG. 3), relative to the rotation of the door 20 about the hinge axis A. The closed position is achieved when the front end 22 of the door 20 is biased by the counter weight 40 into contact with the front edge 12 of the frame 10, and parallel side edges 26, 28 also contact the respective side members 14, 16 of the frame 10. The open position is attained when a positive air pressure in the duct overcomes the bias provided by the counter weight and induces the door away from contact with the frame 10 such that the front end 22 and the side edges 26, 28 are spaced from the respective frame members.

As is apparent to those skilled in the art, positive air pressure inside of the duct 56 will open the door 20 and maintain the door in the open position against the gravitational bias of the counterweight as long as the positive air pressure continues, thus enabling air to exit the duct vent 54 and diffuse into the room.

The counterweight 40 is provided with a sufficient weight, such that when the positive air pressure force on the door 20 from the duct vent becomes negligible as compared to the gravitationally biased closing force, the counterweight biasly rotates the door about the axis A—A into the closed position. With no pressure inside the duct, the gravitational force acting on the counterweight 40 rotates the first and second flange extensions 42, 44 in a downward manner about the axis A—A away from the ceiling 20. Thus, the counterweight 40 induces the door 20 to rotate respectively about the axis A—A towards the frame and the front end 24 and side edges of the door are brought into contact with the frame 12, and thus the duct vent closure 1 substantially seals off and insulates the ambient room air from the duct 56.

The increase of air pressure within the HVAC duct applies a force to the door 20 such that the closing bias provided by the counterweight is overcome and causes the counterweight to be rotated about the hinge axis A and raised toward the ceiling, thus rotating the door 16 away from the frame in order to enable the air flow created by the positive increase in pressure to flow outwards from the duct vent closure. As the door 20 opens when such a positive air pressure is placed on the door, the counterweight 18 is swung upwards towards the ceiling 20 thus enabling the air to escape from the duct vent closure. When the pressure becomes negligible, as explained previously, the counterweight 40, again under the influence of gravity, falls away from the ceiling, rotating the door from the open position to the closed position to seal the duct vent closure opening 54 and prevent the escape of treated air, back into the duct work.

A further description of the hinge axis A—A and the rotatable connection between the door 20 and the hinge pins 35 and 37 of the frame 10 will now be provided.

The first and second aperture flanges 30 and 32 of the door 20 may define a complete aperture 34, 36 through each flange, as shown in FIGS. 1–4. As is readily apparent to a person of ordinary skill in the art, the first and second hinge pins 35, 37 which extend along the axis A—A outwardly from the ends of the rear hinged edge, can engage the apertures 34, 36 and extend through the apertures to rotatably secure the door 20.

Figure 5:
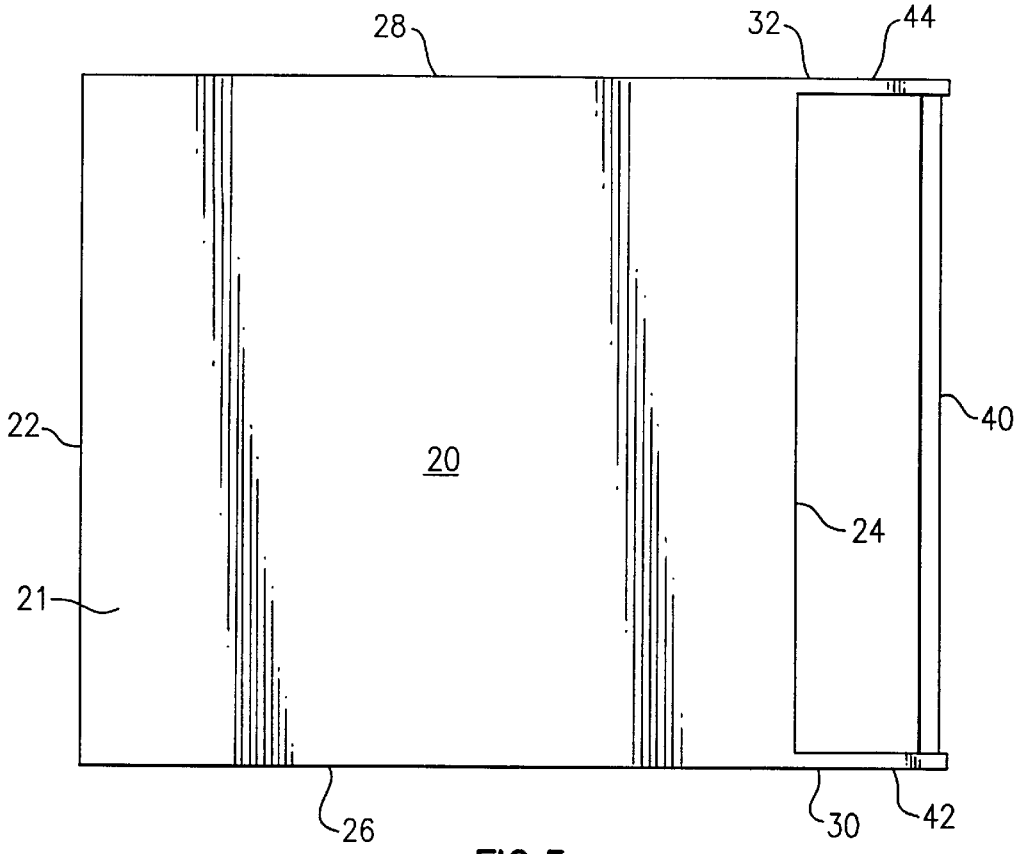
FIG. 5 is a top planer view of the duct closure door and counterweight attached with flange extensions.

In another embodiment, the aperture flanges 30, 32 can define a semi-enclosed aperture 60 through which the first and second hinge pins 35 and 37 also extend, rotatably supporting the door 20. The aperture flanges 30, 32 which define the semi-enclosed aperture 60 as shown in FIG. 5 include a hook shaped portion 62 which partially encircles the axis A, encompasses the hinge pins 35, 37 around a top portion thereof and depends downward to an endpoint wherein the hook portion 62 ends defining an engagement and disengagement slot 64 which communicates with the semi-enclosed aperture 60. The slot 64 is thus formed between the endpoint of the hooked shaped member 62 and an opposing portion of the flange extension 42 and 44. The slot 64 creates a passageway having a width just greater than the diameter of the hinge pins through which the hinge pins 35, 37 are allowed to engage or disengage with the semi-enclosed aperture in order to support the door 20.

Figure 6:
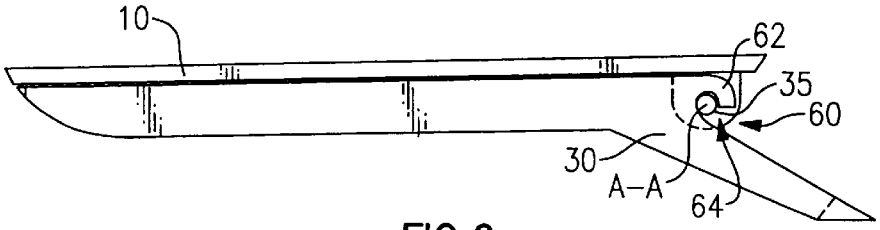
FIG. 6 is a side elevational view of a second embodiment having an alternate hinge attachment.
Figure 7:
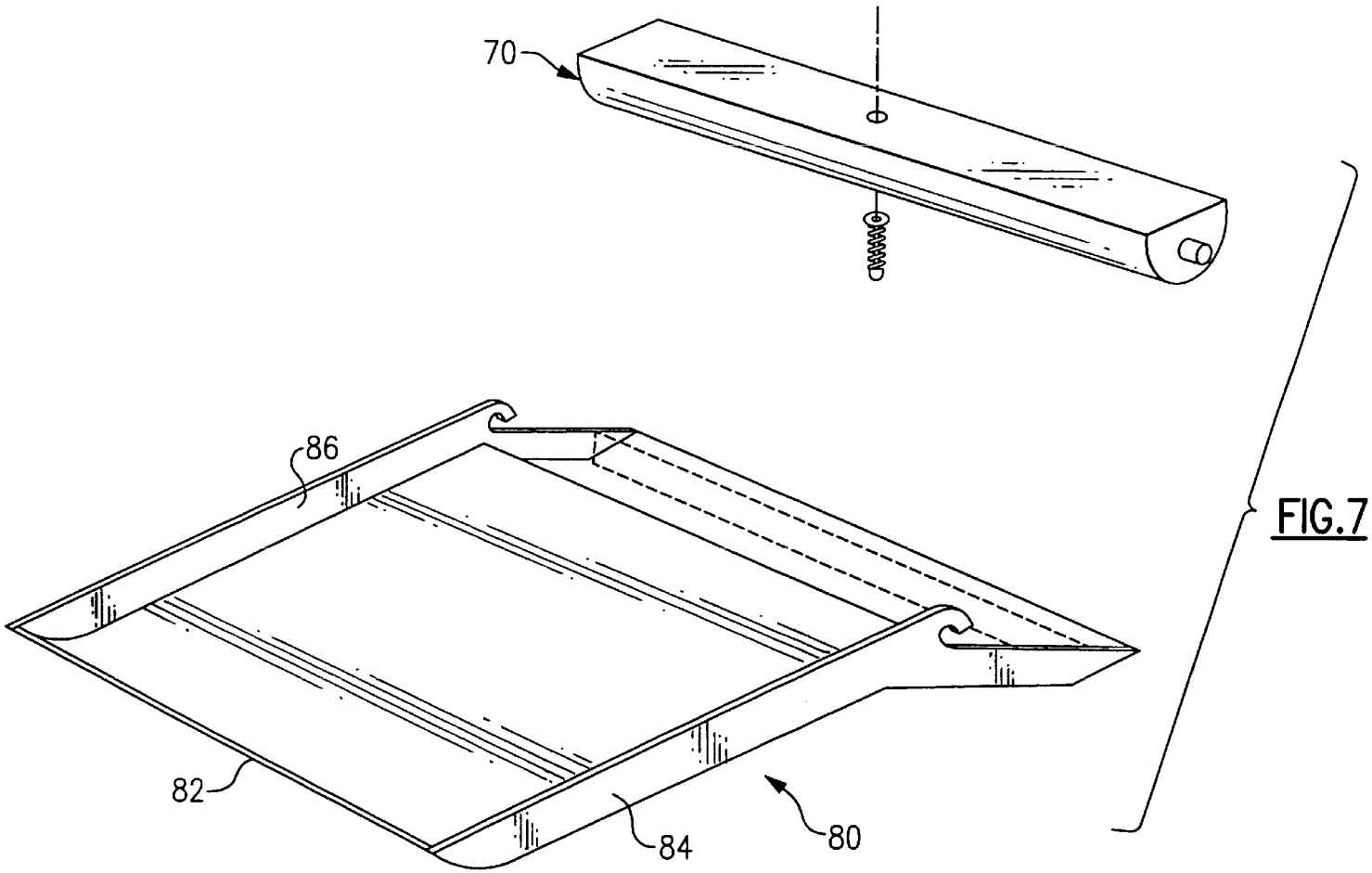
FIG. 7 is an alternative embodiment without a four sided frame having only a rearward hinge member to support a door having a number of raised edges.

As is apparent from observing FIGS. 6 and 7, the hooked shaped portions 62 of the of the flange extensions allow the door 20 to be positively supported by the hinge pins 35 and 37 in both a closed and opened position. The hook shaped portion 62 enables the door 20 to open under the influence of the positive pressure induced in the duct vent with the door continuing to be supported and retained via the hook shaped portions extending around a substantial portion of the circumference of the hinge pins despite the rotation of the semi-circular aperture 60 about the hinge pins 35, 37.

As will be apparent to those skilled in the art, as the door 20 is opened and rotates about the hinge axis A—A, at a certain position, the engagement/disengagement slot 64 reaches a position where the slots 64 are substantially vertically aligned above the hinge pins. At this position, a user may manually disengage the door 20 from the frame due to the clearance provided by the removal slots 64 to allow the semi-circular apertures 60 to slide off and past the hinge pins 35 and 37 thus removing the door from the frame 10 and hinge. A similar reverse process is utilized for engaging the door 20 with the hinge pins.

In order to ensure that the door 20 does not detatch by itself, the door 20 is provided with a specific weight to balance against the outflow of air from the airflow duct vent 54 and the counter balance 40 in order to discourage over rotation of the door during the outflow of air and any chance that the door might inadvertently over rotate and fall off.

In addition, the flange extensions 42, 44 which support the counterweight 40, can be designed with a length to keep the door from over rotating by ensuring that the rotation of the door 20 is stopped by contact of the flange extensions and the counter weight with the ceiling during introduction of treated air to a room. This limit on the over rotation of the door, ensures that the semi-circular attachment aperture will not be completely rotated off the first and second hinge pins 35 and 37 wherein the door would be caused to fall off under the force of gravity through the removal slot 64 without intervention by a user.

The object of utilizing an engagement disengagement slot 64 as described above is so that a user may, by hand, rotate the door 20 such that the removal slot 64 is substantially vertically aligned with respect to the hinge pins 35 and 37 and thus the door 20 may be removed from the frame by manually sliding the door down and away from the hinge pins for cleaning or replacing as necessary.

As seen in FIG. 7, a complete frame 10 as previously described is not necessary to the operability of the present invention. A sole linear hinge member 70 having protruding hinge pins 35, 37 may be anchored or attached adjacent an opening of a duct vent 54. Without any further remaining frame members against which the door 20 can provide a substantial seal around the circumference of the door 20, a slightly modified door such as will be described below can be attached in the aforesaid manner via either partial or fully formed attachment apertures.

The modified door 80, which could be used with or without a complete frame 10, is formed having at least a front edge and the two (2) side edges defined by raised front and side lips 82, 84 and 86 respectively. The lips are designed to engage substantially with an edge of the duct vent or the ceiling around the opening of the duct vent in order to encompass a portion of a duct vent frame already incorporated in the ceiling or present in the duct work of the HVAC system.

The lips 82, 84 and 86 are designed to securely and sealably encompass the duct vent opening 54 and secure the periphery thereof, so when in a closed position, no back flow or leakage of air from a room is lost as previously described through the duct work.

Figure 8:
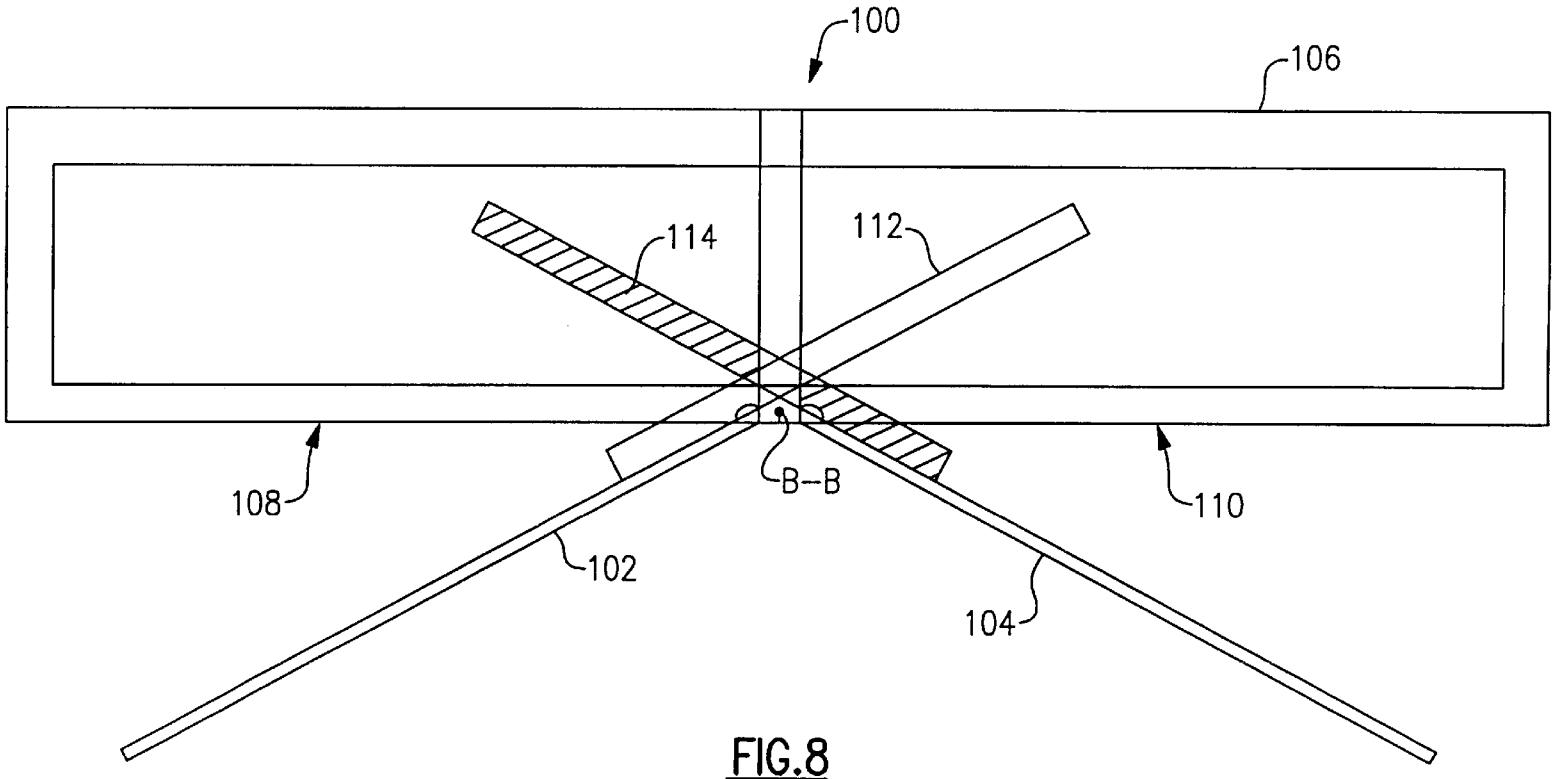
FIG. 8 is a double door duct vent closure system wherein the counterweights are housed within the duct vent closure housing.

Turning to FIG. 8, another embodiment of the present invention may utilize a double door duct vent closure apparatus 100. The double doors 102, 104 allow for a more equal discharge of air on all sides of the duct vent closure apparatus 100 in order to provide desired air discharge and circulation within a room. The duct vent closure apparatus 100 is provided with a compact frame 106 defining a central axis B—B, extending through about the center of the frame 106.

The double doors 102 and 104 respectively are attached and rotatable in mutually opposite directions around the central axis B—B.

Each of the doors 102, 104 is provided with an opposing counterweight 112, 114. In the closed position, the counterweights of these doors are provided to extend substantially parallel with a rear edge of the door to which they are attached, beyond the axis B—B and opposite the doors with respect to the axis B—B. The doors 102, 104 which, when in the closed position with respect to the duct vent, are parallel and lie substantially within the same plane, also have an open position when a positive air pressure is induced in the HVAC system not dissimilar from the duct vent closure previously discussed.

In the open position as shown, the doors 102, 104 rotate about the substantially same axis B—B, forming opposing openings from one another, that is, the open portions 110 of the frame through which the forced air is allowed to emanate are facing directly away from one another to allow air to exit simultaneously in opposite directions from the duct 100.

As is readily apparent from the description, the counterweights 112, 114 are enclosed and rotate within the frame while continuing to counter balance the doors in the desired manner. The counterweights are not exposed and visible within the room as in the previous embodiments. This provides a cleaner, more compact appearance and fewer obstructions or protrusions into the room.

As is apparent to a person of skill in the art, the problem must be solved of the counter weights 112, 114 of the two doors 102, 104 interfering with one another. Because the doors 102, 104 rotate about substantially the same axis B—B in an opposing manner and at the same time and open into a room to allow passage of air, the counterweights 112, 114, which overlap the adjacent door, must provide the desired counterbalance in order to properly bias the doors into the open and closed positions without interfering with one another. This is accomplished by slightly laterally off-setting the first and second flange extensions 108, 109 of each door 102, 104 along the axis B—B, so that the extensions and counterweights rotate without interfering with one another.

The counterweights 112, 114, on each of the doors are positioned and rotate inside at least one of the duct and the duct vent closure frame. In other words, the counterweights do not extend past the air flow duct vent opening 54 in either the closed or the open position. For example, where the door having the counterweight is in the closed position, i.e. substantially sealably engaged with the duct vent frame 106 to prevent airflow there through, the counterweight is parallel to and in a substantially planer relationship with the door, however the counterweights 112, 114 which, as can be seen, partially overlaps the adjacent door, is specifically positioned in a slightly more inward plane, in relation to the duct vent opening and with respect to the plane of the doors 102, 104. As can be readily appreciated this slightly inward positioning of the counterweights 112, 114 allow the doors to simultaneously close without interference from the overlapping counterweight of the adjacent door. In all other respects, the double door duct vent closure operates in manner substantially the same as the embodiment with only a single door.

Figure 9:
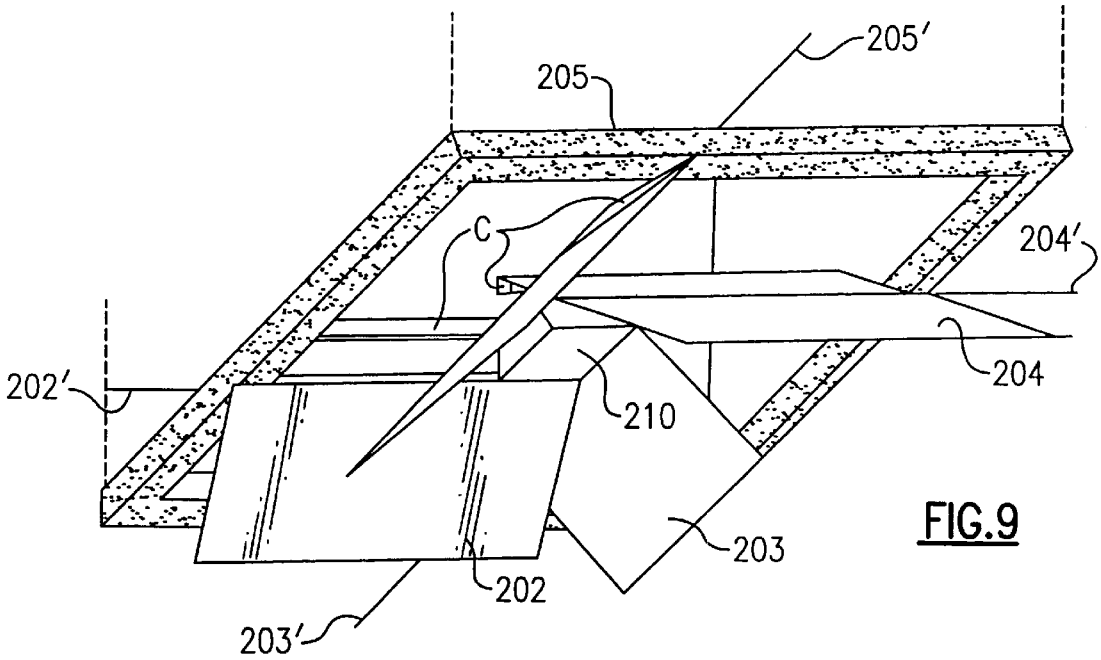
FIG. 9 is a four door duct vent closure system wherein the counterweights are housed within the duct vent closure housing.

Observing FIG. 9, a further embodiment of the invention provides up to four hinged and counter weighted doors 202, 203, 204 and 205 working substantially in unison to ensure a complete 360 degree out flow of treated air from the duct. As discussed above, it is desirable that the duct vent apparatus provide an efficient and effective diffusion of air throughout the room. The duct vent shown discloses 4 doors or louvers 202, 203, 204 and 205, which enable the treated air to be directed outwardly to all sides of the apparatus to accomplish the desired 360 degree diffusion.

Each of these doors is shown in the figure as having an individual axis 202', 203', 204' and 205' about which each respective door individually rotates. The axis extend perpendicularly between a central joint 210 and the closest associated frame edge to provide the respective hinge axis about which each door may rotate.

As is apparent to any person of ordinary skill in the art, the 4 doors, 202–205 may also be arranged on two axis, each of the two axis supporting two oppositely opening doors.

The doors 202–205 are influenced into a closed position by counterweights C in a similar manner as described in conjunction with FIG. 8. The counterweights C attached on each of the doors are positioned and rotate inside the duct vent and the duct vent closure frame. In other words, the counterweights C do not extend past the duct vent opening in either the closed or the open position. For example, where the door having the counterweight C is in the closed position, i.e. substantially sealably engaged with the duct vent opening to prevent airflow there through, the counterweight is parallel to and in a substantially planer relationship with the door, however the counterweight which partially overlaps the adjacent door, is specifically positioned in a slightly more inward plane, in relation to the duct vent opening and with respect to the plane of the doors in the closed position. As can be readily appreciated this slightly inward positioning of the counterweights C allows the adjacent door to simultaneously close without interference from the respective adjacent counterweight C.

FIGS. 10, 11 and 12 disclose yet another embodiment of the present invention. In general a frame 210 supports a plurality of counterweighted parallel louvers 220 extending longitudinally between opposing first and second sides 216, 218 of the frame 210. A respective first and second ends 226, 228 of each of the parallel louvers is attached to the first and second sides 216, 218 of the frame at respective opposing pivot points 235, 237. The opposing pivot points 235, 237 define a pivot axis PA about which each louvre rotates individually. A further description of the louvers is provided below.

The louvers 220 as shown in FIGS. 11 and 12 have a cross-section defining an airfoil profile. The airfoil profiled louvre 220 has a substantially wider nose portion 241 on one side of the pivot axis PA tapering to a relatively thinner tail section 243 along a first and second edges 245, 247 on an opposing side of the pivot point PA. Each of the tapering first and second edges 245 and 247 have a different chord length, such that, as is well known in the art of fluid mechanics and based on Bernoulli's theorem, a fluid flow passing across the longer chord length, for example, the first edge 245, must be faster than the fluid flow over the shorter length chord, in this case, the second edge 247, thus creating a pressure differential, or "lift" between the first and second edges 245, 247. The "lift" experienced by the louvers in the present invention, is translated into rotation of each louver 220 about the pivot axis PA. The louvers rotate in such a manner that the front nose portion 241 is turned upstream into the air flow, and the relatively thinner tail section 243 extends in a downstream direction much like the alignment of an airplane wing in respect to the airflow during flight. As Bernoulli's theorem and the results thereof are well known to those of skill in the art no further discussion is provided herein.

Each of the plurality of airfoil profiled louvers 220, the front nose portion 241 has incorporated therein a counterweight 242 having a center of mass m spaced from the pivot axis PA on the one side of the pivot axis PA and on the opposing side of the pivot axis the narrow tail section 243 provides a balancing force to each louver 220 about the pivot axis PA. When in a neutral, or substantially unbiased position, the vent is closed and the plurality of parallel louvers substantially completely obstruct the vent opening by the front nose portion 241 of each adjacent louver abutting with the tail end 245 of the narrow tail section 243 of each adjacent parallel louver.

It is to be appreciated that the balancing forces of the front nose portion 241 and the narrow tail section 243 can be appropriately adjusted on either side of the pivot point PA to sustain the louver 220 in any desired neutral unbiased or balanced position. For instance, in order to provide a more secure closure it is desirable to maintain a force and weight alignment such that in the neutral position the tail section 243 extends upwardly towards the vent at least slightly higher relative to the front nose portion 241. This force and weight balance would create a tighter seal between the adjacent tail end 245 and abutting front nose portions 241 of adjacent louvers 220.

In the closed position the airfoil profile louvers 220 are biased due to their counterweighted nature into a substantially horizontal position with respect to the potential air flow AF as shown in FIG. 10 thus closing the opening through the vent as discussed above. When sufficient air flow AF is provided within the duct, the airflow pushes down on the second edge 247 of tail section 243 of the louvers 220, and the pressure created thereon overcomes the bias of the counter weight provided in the nose portion 241 of each louver. The louvers 220 are thus rotated out of the closed position and into an open position, allowing the air flow AF to pass from the duct, through the vent and into the room.

As the louvers 220 are rotated into the open position, it is to be appreciated that each louver becomes substantially inclined to a more aerodynamic position, i.e. the nose portion 241 of each louver is rotated into the air flow AF, towards the direction from which the air flow emanates. As can be appreciated by those of skill in the art, in addition to the pressure provided by the air flow AF pushing directly on the first edge 245, as each louver becomes more aerodynamically inclined or more parallel relative to the air flow AF, a pressure differential develops creating a higher lifting pressure on the second edge 247 of the airfoil profile as discussed above thus adding a further additional rotation or "lift", as in an airplane wing, to the airfoil and providing for an increase in the opening of the vent due to the combination of the duct pressure and the pressure differential created across the first and second edges 245, 247.

As is to be appreciated, upon the reduction of the airflow AF and the higher air pressure in the duct, the counterweight 242 in the front nose portion 241 of the louver 220 overcomes the air pressure and thus rotates the louver 220 about the pivot axis back into a substantially horizontally position relative to the potential airflow AF wherein the tail end 246 of each of the airfoil louvers abuts the front nose portion 241 of an adjacent louver in order to close the opening of the duct vent.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

I claim:

1. An air duct vent closure device for an HVAC duct vent defining an opening for at least one of introduction to and withdrawal of air from a room, the duct vent closure device comprising:

a door having a counterweight oppositely disposed about and supported by a hinge axis positioned adjacent the duct vent opening, the hinge axis is delineated by a first and second hinge pins linearly arranged and rotatably supporting the door;

a closed position wherein the counterweight influences the door into sealable contact with the duct vent opening to block air flow there through;

an open position wherein a positive pressure induced by the HVAC system overcomes the influence of the counterweight, causing the door to disengage from sealable contact with the opening and allow air flow there through;

the door further comprises an outer edge providing sealable contact with the duct vent in the close position, the outer edge also having a first and second hinge pin engagement apertures for rotatably engaging the first and second hinge pins to provide rotatable engagement of the door and counterweight about the hinge axis; and wherein the duct vent opening is located substantially in a plane defined by a ceiling of the room and the door in the closed position is substantially co-planer with the ceiling plane and sealably covers the duct vent opening due to the influence of the counter weight providing a biasing leverage to the door about the hinge axis, the counterweight being positioned and moveable in the room immediately below the ceiling plane; and the door is shaped as an air foil, the front portion of the door defining a leading edge of the air foil and the trailing portion defining a trail edge of the air foil.

2. The air duct vent closure device as set forth in claim 1 wherein the front portion and trailing portion of the door define a cross-section tapering from a thicker front portion to a thinner trailing portion.

3. The air duct vent closure device as set forth in claim 2 further comprising a first and second tapering edges extending between the thicker front portion and the thinner trailing portion wherein one of said first and second tapering edges has a longer chord length than the other to develop a pressure differential between the first and second tapering edges when the door is positioned in the air flow.

4. The air duct vent closure device as set forth in claim 3 wherein the shorter front portion of the door forms the counter weight to balance the front portion of the door against the associated trailing portion of the door into a closed position.

5. The air duct vent closure device as set forth in claim 4 wherein a sufficient air flow in the air duct vent overcomes the balance between the shorter and longer portions of the door and rotates the door into the open position and wherein the pressure differential developed across the airfoil due to the differing chord lengths provides additional rotational force to further overcome the potential bias of the counter weighted front portion in the open position.

* * * * *